US011454261B2

(12) United States Patent
Klassen et al.

(10) Patent No.: US 11,454,261 B2
(45) Date of Patent: Sep. 27, 2022

(54) SYSTEM AND METHOD INCLUDING A FLUIDIC ACTUATOR AND A PRESSURIZED FLUID PROVISION DEVICE

(71) Applicant: Festo SE & Co. KG, Esslingen (DE)

(72) Inventors: Daniel Klassen, Esslingen (DE); Rüdiger Neumann, Ostfildern (DE); Valentin Falkenhahn, Stuttgart (DE); David Rager, Nürtingen (DE); Gerhard Gommel, Notzingen (DE)

(73) Assignee: Festo SE & Co. KG, Esslingen (DE)

( * ) Notice: Subject to any disclaimer, the term of this patent is extended or adjusted under 35 U.S.C. 154(b) by 275 days.

(21) Appl. No.: 16/829,726

(22) Filed: Mar. 25, 2020

(65) Prior Publication Data

US 2020/0309167 A1 Oct. 1, 2020

(30) Foreign Application Priority Data

Mar. 29, 2019 (DE) ..... 102019204497.2

(51) Int. Cl.

| | |
|---|---|
| ***F15B 21/00*** | (2006.01) |
| ***F15B 9/09*** | (2006.01) |
| ***F15B 11/08*** | (2006.01) |
| ***F15B 15/20*** | (2006.01) |
| ***F15B 15/28*** | (2006.01) |

(52) U.S. Cl.

CPC ..... *F15B 21/001* (2013.01); *F15B 9/09* (2013.01); *F15B 11/08* (2013.01); *F15B 15/20* (2013.01); *F15B 15/2815* (2013.01); *F15B 2211/30575* (2013.01); *F15B 2211/6306* (2013.01); *F15B 2211/6336* (2013.01)

(58) Field of Classification Search

CPC .. F15B 9/08; F15B 9/09; F15B 13/044; F15B 2013/0448; F15B 15/2815; F15B 21/08

See application file for complete search history.

(56) References Cited

U.S. PATENT DOCUMENTS 4,227,440 A * 10/1980 Leonard ..... F15B 13/043 91/506
5,829,335 A * 11/1998 Ewald ..... F15B 21/087 91/363 R
6,523,451 B1 * 2/2003 Liao ..... F15B 9/09 91/363 R (Continued)

FOREIGN PATENT DOCUMENTS

DE 9210096 U1 9/1992
DE 4417153 C1 11/1995
DE 102009017879 A1 * 10/2010 ..... F15B 11/006

*Primary Examiner* — Michael Leslie
(74) *Attorney, Agent, or Firm* — Hoffmann & Baron, LLP

(57) ABSTRACT

A system, including: a fluidic actuator which can be acted upon by a pressurized fluid and has an actuator member, a pressurized fluid provision device which is adapted to carry out a position control of the actuator member and, within the position control, to act upon the fluidic actuator with the pressurized fluid in order to move the actuator member into a prescribed position, and a hose arrangement, including at least one hose via which the fluidic actuator is fluidically connected to the pressurized fluid provision device, wherein the pressurized fluid provision device is adapted to carry out the position control taking into account a system model describing the hose arrangement, the actuator and/or the pressurized fluid provision device.

16 Claims, 4 Drawing Sheets

(56) References Cited

U.S. PATENT DOCUMENTS

| | | | | |
|---|---|---|---|---|
| 6,751,954 | B2 * | 6/2004 | Bridger | F15B 15/18 60/475 |
| 7,021,191 | B2 * | 4/2006 | Moler | G05B 19/43 91/393 |
| 10,808,738 | B2 * | 10/2020 | Doll | F15B 21/08 |
| 2012/0000543 | A1 * | 1/2012 | Keintzel | F15B 21/008 137/12 |
| 2019/0078592 | A1 * | 3/2019 | Schiesser | F15B 9/09 |

* cited by examiner

SYSTEM AND METHOD INCLUDING A FLUIDIC ACTUATOR AND A PRESSURIZED FLUID PROVISION DEVICE

BACKGROUND OF THE INVENTION

The invention relates to a system comprising a fluidic actuator which can be acted upon by a pressurized fluid and has an actuator member, a pressurized fluid provision device which is adapted to carry out a position control of the actuator member and, within the position control, to act upon the fluidic actuator with the pressurized fluid in order to move the actuator member into a prescribed position, and a hose arrangement comprising at least one hose, via which the fluidic actuator is fluidically connected to the pressurized fluid provision device.

The pressurized fluid provision device includes, for example, a valve terminal connected to the fluidic actuator via the hose. The fluidic actuator is for example a pneumatic drive cylinder.

The system is expediently used in industrial automation, for example to position a drive object, such as a tool, a workpiece and/or a machine part, via the actuator member.

The fluidic actuator comprises one or more pressure chambers which are pressurized by the application of the pressurized fluid within the position control in order to effect the positioning of the actuator member. On the fluidic actuator itself there is expediently no pressure sensor, so that the pressure in the pressure chamber of the fluidic actuator cannot be measured directly. The pressurized fluid is preferably compressed air. A position control by means of applying compressed air is also referred to as servo-pneumatics. The position control is a closed-loop position control.

SUMMARY OF THE INVENTION

It is an object of the invention to provide a system that can be used more flexibly.

The object is solved by a system having a pressurized fluid provision device which is adapted to perform the position control taking into account a system model describing the hose arrangement, the actuator and/or the pressurized fluid provision device.

The pressurized fluid provision device is especially adapted to provide a model-based position control. The system model includes system parameters that describe, for example, physical properties such as dimensions and/or masses of the hose arrangement, the actuator and/or the pressurized fluid provision device. For example, the system model includes as a system parameter the length, diameter and/or volume of a hose of the hose arrangement. Furthermore, the system model may include as a system parameter the dimensions and/or mass (to be set in motion during position control) of the actuator which is in particular designed as a drive cylinder. Furthermore, the system model may include system parameters describing control properties of the pressurized fluid provision device, in particular control properties of a valve device of the pressurized fluid provision device. The control properties are closed-loop control properties. In addition, specific properties of the sensors used for the position control can be taken into account via the system model.

By using the system model, in particular by taking into account system parameters that describe the hose of the hose arrangement, it is possible, for example, to provide position control even when using a longer hose between the pressurized fluid provision device, for example the valve terminal, and the actuator, without having to provide pressure sensors on the actuator itself. Via the system model, in particular via a hose model of the system model, an actuator pressure can be calculated, for example, from a measurement pressure detected at the pressurized fluid provision device, which actuator pressure corresponds to the pressure at the actuator, for example the pressure in a pressure chamber of the actuator. The hose model describes physical properties of the hose, such as the length, diameter and/or volume of the hose. The calculated actuator pressure can also be called calculated chamber pressure.

For very short hose lengths, the difference between the measurement pressure measured at the pressurized fluid provision device and the actuator pressure present at the actuator is very small, so that the measurement pressure can be used as the actuator pressure. As the hose length increases, the difference between the current measurement pressure and the current actuator pressure may increase. By means of the system model, especially the hose model, the influence of the hose on the actuator pressure can be taken into account when calculating the actuator pressure, so that an precise calculation of the actuator pressure based on the measurement pressure is possible even with longer hoses. The calculated actuator pressure can then be used as a feedback variable for the position control.

This makes it possible to use the position control even in cases where longer hoses are used between the pressurized fluid provision device and the actuator (without the need for pressure sensors on the actuator). The system can therefore be used more flexibly—even with longer hoses.

The invention further relates to a method of operating the system described above. The method includes the step: Performing the position control taking the system model into account.

The method is expediently adapted in correspondence to an embodiment of the system.

BRIEF DESCRIPTION OF THE DRAWINGS

In the following, exemplary details and exemplary embodiments are explained with reference to the figures. Thereby shows.

DETAILED DESCRIPTION

Figure 1:
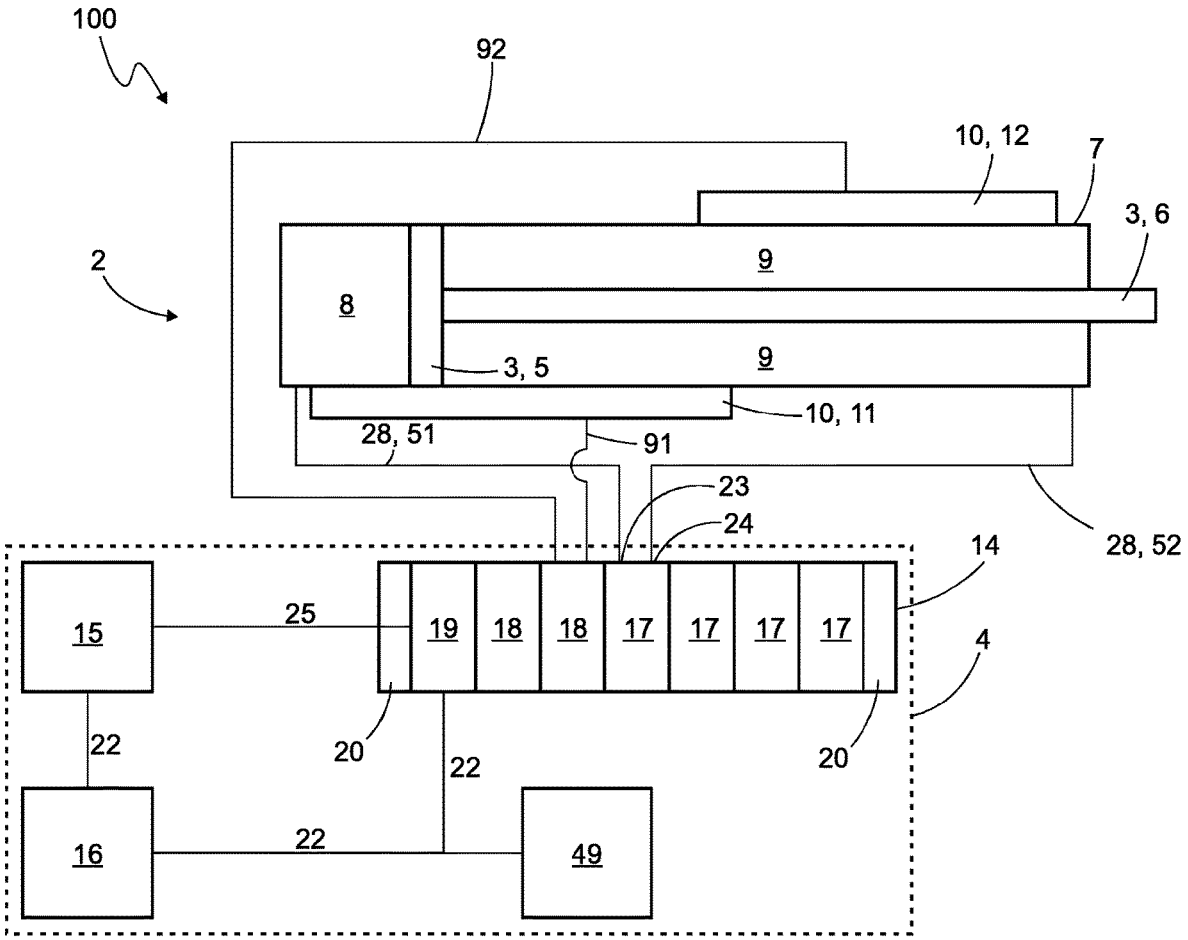
FIG. 1 a schematic view of a system comprising a pressurized fluid provision device, a hose arrangement and a fluidic actuator, FIG. 2 a schematic view of a valve device, FIG. 3 a schematic view of a position controller and FIG. 4 a schematic view of a controller unit of the position controller.

FIG. 1 shows a system 100. The system 100 comprises a fluidic actuator 2 that can be acted upon with a pressurized fluid. The fluidic actuator 2 has an actuator member 3.

The system 100 further includes a pressurized fluid provision device 4, which comprises a valve arrangement 14 designed as a valve terminal, for example. The pressurized fluid provision device 4 is adapted to perform a position control of the actuator member 3 and, as part of the position control, to supply the fluidic actuator 2 with the pressurized fluid in order to move the actuator member 3 to a prescribed position. The position control is a closed-loop position control.

The system 100 further includes a hose arrangement 28, which expediently includes at least one hose 51, 52. The fluidic actuator 2 is fluidically connected to the pressurized fluid provision device 4 via the hose arrangement 28. The pressurized fluid provision device 4 is adapted to supply the fluidic actuator 2 with the pressurized fluid via the hose arrangement 28.

The pressurized fluid provision device 4 is adapted to perform the position control taking into account a system model describing the hose arrangement 28, the actuator 2 and/or the pressurized fluid provision device 4.

Further exemplary details are explained below.

First, the pressurized fluid provision device 4 will be discussed:

The pressurized fluid provision device 4 comprises the valve arrangement 14, exemplarily designed as a valve terminal, via which valve arrangement 14 the pressurized fluid is supplied for the position control of the actuator 2. The valve arrangement 14 does not necessarily have to be a valve terminal. The valve arrangement can also be designed as a single valve or as a different valve unit, for example.

On the valve arrangement 14, two pressure outputs 23, 24 are provided to supply the pressurized fluid, in particular compressed air. Each of the two pressure outputs 23, 24 is fluidically connected to a respective pressure chamber 8, 9 of the fluidic actuator 2. According to an alternative embodiment, the actuator has only one pressure chamber, and only one pressure output is connected to a pressure chamber.

The valve arrangement 14 has a pressure sensor arrangement 29 with pressure sensors which can be used to measure the pressure at the pressure outputs 23, 24 and/or the pressure in a de-aeration port 26 and/or an aeration port 27. The de-aeration port 26 may also be referred to as fluid exhaust port or air exhaust port. The aeration port 27 may also be referred to as fluid supply port or air supply port. These pressure sensors are expediently located on the valve arrangement 14, especially on the valve terminal. As further explained below with reference to FIG. 2, the pressure sensor arrangement 29 includes, as examples, a first pressure output pressure sensor 45, a second pressure output pressure sensor 46, an air exhaust pressure sensor 43 and/or an air supply pressure sensor 44.

As an example, the valve arrangement 14 comprises a plurality of modules, e.g. valve modules 17 and/or I/O modules 18. The valve arrangement 14 also comprises a control unit 19, which is preferably also designed as a module. The valve arrangement 14 has a carrier body 20, in particular a carrier plate, on which the control unit 19, the valve modules 17 and/or the I/O module 18 are arranged.

The valve arrangement 14 is exemplarily designed as a series module arrangement and can also be referred to as a valve terminal. The modules mentioned above are in particular series modules, which are preferably plate-shaped. In particular, the valve modules 17 are designed as valve plates. The series modules are expediently arranged in a row, especially along the longitudinal axis of the valve arrangement 14.

The pressurized fluid provision device 4 further includes, as an example, a superordinate controller 15 and/or optionally a cloud server 16 and/or a user device 49.

The valve arrangement 14 is expediently communicatively connected with the superordinate controller 15 and/or the cloud server 16. Preferably, the valve arrangement 14 is connected to the superordinate controller 15 via a bus 25, in particular a local bus, e.g. a fieldbus, and/or optionally connected to the cloud server 16 via a wide area network 22, e.g. the Internet.

The valve arrangement 14 is communicatively connected to a position sensor device 10 of the actuator 2, in particular via the I/O module 18, e.g. the valve arrangement 14 is communicatively connected to the position sensor device 10 via one or more communication lines 91, 92. Expediently, the position sensor values recorded by the position sensor device 10 are provided to the control unit 19, the superordinate controller 15 and/or the cloud server 16. Expediently, the pressure sensor values of the pressure sensors 43, 44, 45, 46 are provided to the control unit 19, the superordinate controller 15 and/or the cloud server 16.

The fluidic actuator 2 will be discussed in more detail below.

The fluidic actuator 2 is a pneumatic actuator which can be acted upon with compressed air. As an example, the fluidic actuator 2 is designed as a drive, especially as a drive cylinder. The fluidic actuator 2 comprises exemplarily an actuator body 7, the actuator member 3 and at least one pressure chamber 8, 9 The fluidic actuator 2 expediently comprises two pressure chambers 8, 9 which can be separately pressurized with the pressurized fluid and is designed in particular as a double-acting actuator. According to an alternative embodiment, the fluidic actuator has only one pressure chamber and is accordingly designed as a single-acting actuator.

The actuator body 7 is preferably designed as a cylinder and has an internal volume. The actuator member 3 comprises, for example, a piston 5 and/or a piston rod 6. The piston 5 is located in the actuator body 7 and divides the internal volume of the actuator body 7 into the two pressure chambers 8, 9.

The fluidic actuator 2 expediently comprises the position sensor device 10. The position sensor device 10 serves for detecting a position of the actuator member 3. The position sensor device 10 is exemplarily arranged at the outside of the actuator body 7. The position sensor device 10 comprises for example two position sensor units 11, 12, which are distributed along the movement path of the actuator member 3. Exemplarily, the position sensor units 11, 12 together cover the entire movement path of the actuator member 3.

For example, each position sensor unit 11, 12 may include one or more sensor elements, in particular magnetic sensor elements, such as Hall sensor elements. Expediently, a magnet is arranged on the actuator member 3, the magnetic field of which magnet can be detected by the magnetic sensor elements.

Expediently, the position sensor device 10 is adapted to detect the position of the actuator member 3 over the entire movement path of the actuator member 3.

At the fluidic actuator 2, there is expediently no pressure sensor, in particular no pressure sensor for measuring a pressure in one of the pressure chambers 8, 9.

The hose arrangement 28 exemplarily comprises two hoses 51, 52. A first hose 51 fluidically connects the first pressure output 23 with the first pressure chamber 8 and a second hose 52 fluidically connects the second pressure output 24 with the second pressure chamber 9. In an alternative embodiment, in which the fluidic actuator has only one pressure chamber, the hose arrangement expediently comprises only one hose.

The length of one or both hoses 51, 52 is exemplarily each longer than 1.5 m, especially longer than 2 m. Exemplarily, the length of one or both hoses 51, 52 is each up to 5 m long. The length of one or both hoses 51, 52 is preferably each longer than the sum of half the length of the actuator 2 (designed as a drive cylinder) and 40 cm. In particular, the length of one or both hoses 51, 52 is each longer than the sum of half the length of the movement path of the actuator and 40 cm.

The superordinate controller 15 is exemplarily designed as a programmable logic controller, PLC, and is communicatively connected to the valve arrangement 14, in particular to the control unit 19. Expediently, the superordinate controller 15 is connected to the cloud server 16, especially via a wide area network 22, preferably via the Internet. The superordinate controller 15 is adapted to provide a setpoint signal SWS which defines the (setpoint) position to which the actuator member 3 is controlled by the position control. Preferably, the setpoint signal SWS defines the prescribed position.

The user device 49 is exemplarily a mobile device, for example a smartphone, a tablet computer and/or a laptop. Furthermore, the user device 49 can be a desktop computer, for example a PC. The user device 49 is expediently communicatively connected to the control unit 19, the cloud server 16 and/or the superordinate controller 15, in particular via a wide area network 22, for example the Internet. The user device 49 is in particular designed for user input of one or more system parameters of the system model. The user device 49 can be used to access a user interface that is provided on the cloud server 16, the controller 15 and/or the control unit 19, for example. The user interface is expediently a web interface. The user interface is used in particular for the input of the model parameter by the user. Furthermore, the user interface is preferably used to select, activate and/or load onto the control unit 19 the application program that provides the position controller 50, which is explained below.

The cloud server 16 is expediently located remote from the valve arrangement 14 and/or the fluidic actuator 2, especially in a different geographic location. Preferably, the cloud server 16 is adapted to provide an application program with which the position control can be performed. The application program can be loaded from the cloud server 16 to the superordinate controller 15 and/or the control unit 19, expediently in response to a user input made with the user device 49.

Figure 2:
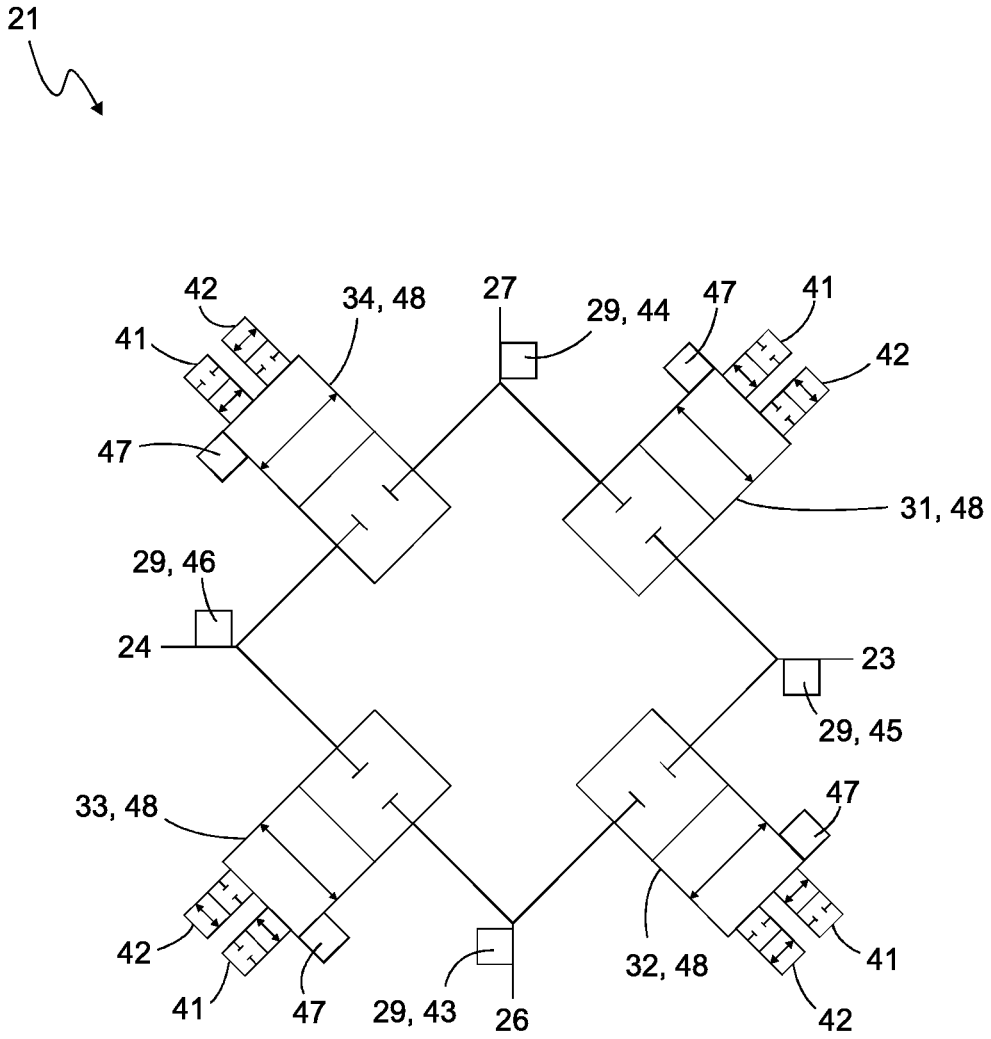

FIG. 2 shows an exemplary valve device 21, with which the pressures for the pressure chambers 8, 9 can be provided. The valve device 21 is part of the pressurized fluid provision device 4, in particular the valve arrangement 14, preferably a valve module 17.

The valve device 21 has the two pressure outputs 23, 24 with which two separate pressurized fluid pressures and/or two separate pressurized fluid mass flows can be provided. The valve device 21 further has a de-aeration port 26 connected to a de-aeration line and an aeration port 27 connected to an aeration line. Expediently, a supply pressure is applied to the aeration port 27 and/or the atmospheric pressure is applied to the de-aeration port 26.

The valve device 21 comprises, for each pressure output 23, 24, one or more valve members 48, by means of which the size of a respective output opening can be adjusted, which output opening the pressurized fluid passes through when the pressurized fluid is provided at a respective pressure output 23, 24.

In FIG. 2, the valve device 21 is exemplarily adapted as a full bridge of four 2/2-way valves 31, 32, 33, 34. A first 2/2-way valve 31 is connected between the aeration port 27 and the first pressure output 23, a second 2/2-way valve 32 is connected between the first pressure output 23 and the de-aeration port 26, a third 2/2-way valve is connected between the de-aeration port 26 and the second pressure output 24 and a fourth 2/2-way valve is connected between the second pressure output 24 and the aeration port 27.

The first pressure output 23 can be selectively connected via the first 2/2-way valve to the de-aeration line or via the second 2/2-way valve to the aeration line. The second pressure output 24 can be selectively connected via the third 2/2-way valve to the de-aeration line or via the fourth 2/2-way valve to the aeration line.

Each 2/2-way valve 31, 32, 33, 34 is exemplarily adapted as a proportional valve; i.e. each 2/2-way valve 31, 32, 33, 34 has a valve member 48 which can be set to an open position, a closed position and any intermediate positions between the open and closed position. Preferably, the 2/2-way valves 31, 32, 33, 34 are pilot operated valves, each of which has two pilot valves 41, 42 via which the valve member can be actuated. The pilot valves 41, 42 are exemplarily designed as piezo valves. The position of the respective valve member 48 can be used to adjust the above-mentioned output opening.

As an example, the first and second 2/2-way valves 31, 32 form a first half bridge and the third and fourth 2/2-way valves 33, 34 form a second half bridge. Preferably, the output opening of the first pressure output 23 can be set via the first half bridge and the output opening of the second pressure output 24 can be set via the second half bridge.

The valve arrangement 14 expediently comprises the pressure sensor arrangement 29 with one or more pressure sensors to detect pressures of the valve arrangement 14, in particular the valve device 21.

As an example, the valve arrangement 14, in particular the valve device 21, comprises a first pressure output pressure sensor 45 for detecting the pressure provided at the first pressure output 23 and/or a second pressure output pressure sensor 46 for detecting the pressure provided at the second pressure output 24. Expediently, the valve arrangement 14, in particular the valve device 21, further includes an air supply pressure sensor 44 for detecting the pressure provided at the aeration port 27 and/or an air exhaust pressure sensor 43 for detecting the pressure provided at the de-aeration port 26.

The valve arrangement 14, especially the valve device 21, expediently comprises stroke sensors 47 for detecting the position of the valve members 48. The pressurized fluid provision device 4 is especially adapted to determine the size of the output openings of the pressure outputs 23, 24 by means of the stroke sensors 47.

In the following, with reference to FIG. 3, the position control performed by the pressurized fluid provision device 4 will be discussed in more detail.

The pressurized fluid provision device 4 is expediently adapted to provide the position control over the entire movement path of the actuator member 3. Preferably, the pressurized fluid provision device 4 is adapted to position the actuator member 3 to an arbitrary position along the movement path by means of the position control. Expediently, the actuator member 3 can be positioned at any arbitrary position along the movement path by means of the position control.

Figure 3:
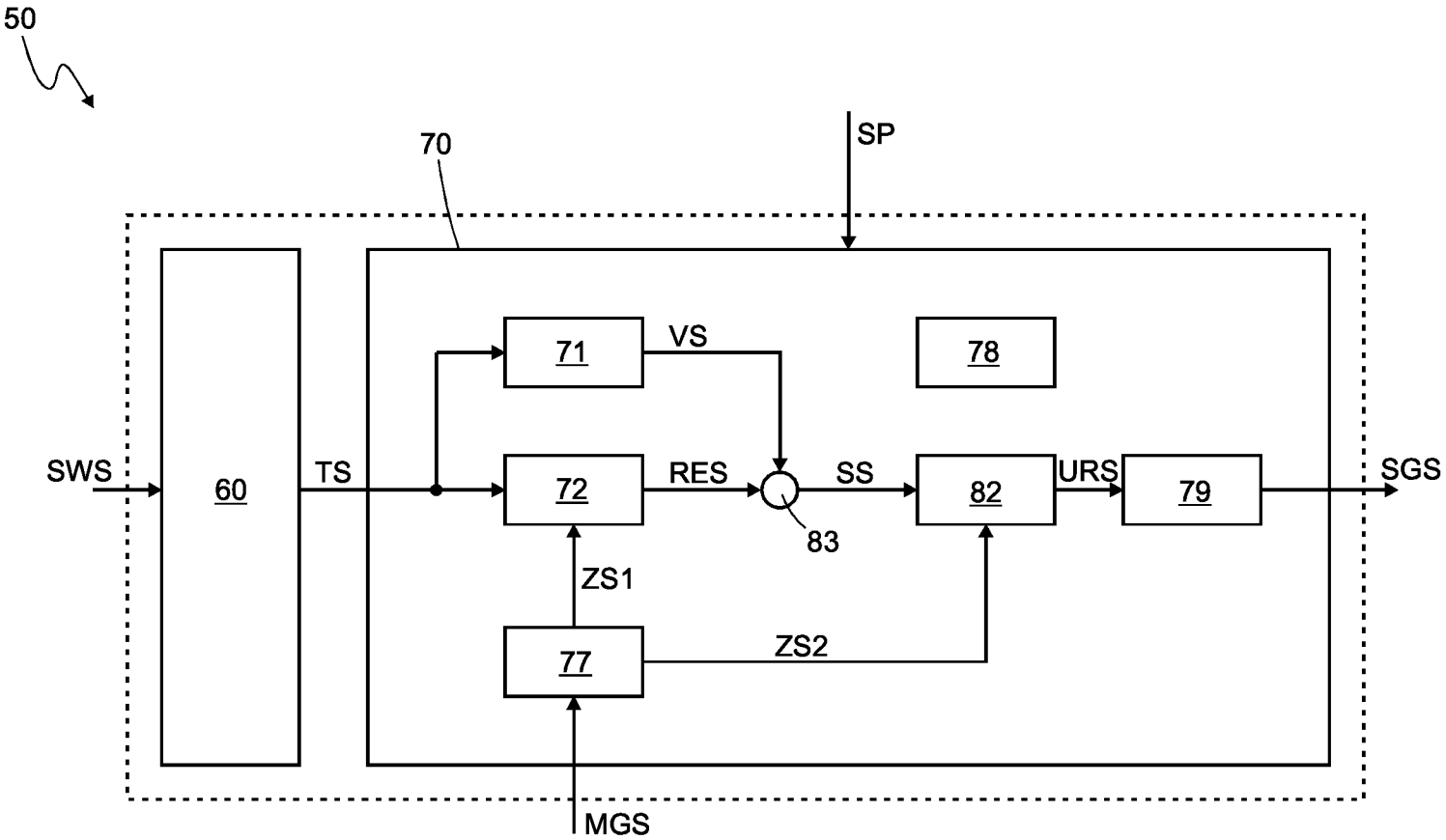

FIG. 3 shows an exemplary position controller 50 for providing the position control of the actuator member 3. The position controller is expediently implemented as a program, in particular as an application program, which is executed in particular on the valve arrangement 14, preferably on the control unit 19. The position controller 50 is especially executed on a microcontroller of the control unit 19. Alternatively or in addition, the position controller 50 can also be executed on the cloud server 16 and/or the superordinate controller 15.

The position controller 50 is adapted to provide a command variable signal SGS based on a setpoint signal SWS. The command variable signal SGS may also be referred to as reference variable signal. The setpoint signal SWS is provided, for example, by the control unit 19, the controller 15 and/or the cloud server 16. The setpoint signal SWS expediently includes a position setpoint signal. The valve arrangement 14 is adapted to control the valve device 21, in particular the 2/2-way valves 31, 32, 33, 34, in particular their pilot valves 41, 42, on the basis of the command variable signal SGS. As an example, one or more conductance values are specified by the command variable signal SGS, according to which the positions of the valve members 48—and thus the output openings of the pressure outputs 23, 24—are set.

The position controller 50 is especially adapted to provide the command variable signal SGS as a function of the setpoint signal SWS, a measurement variable signal MGS and/or a system parameter SP of the system model.

The measurement variable signal MGS expediently comprises measured values of the position sensor device 10, the pressure sensor arrangement 29, in particular the pressure sensors 43, 44, 45, 46, and/or the stroke sensors 47. The measurement variable signal MGS thus comprises in particular a measured position of the actuator member 3, a measured pressure at the de-aeration port 26, a measured pressure at the aeration port 27, a measured pressure at the pressure output 23, a measured pressure at the pressure output 24, and/or the measured positions of the valve members 48. The measured pressures can expediently be provided in the measurement variable signal MGS as pressure differences. Furthermore, the measured positions can be provided as conductances in the measurement variable signal MGS.

The system parameter SP is a parameter of the system model, in particular entered by a user, for example via the user device 49.

The position controller 50 comprises, exemplarily, a trajectory planner section 60 and a controller section 70. The trajectory planner section 60 provides a trajectory signal TS based on the setpoint signal SWS. For example, the trajectory planner section 60 applies a velocity and/or acceleration and/or jerk limitation to the setpoint signal SWS and provides, as the result, the trajectory signal TS. In this way, signal jumps which may be contained in the setpoint signal SWS can be smoothed out so that they can be better handled by the controller section 70. The trajectory signal TS is fed to controller section 70.

According to an alternative embodiment, the trajectory planner section 60 is not present. In this case, the setpoint signal SWS fed to the position controller 50 expediently serves as the trajectory signal TS which is fed to the controller section 70.

The trajectory signal exemplarily comprises a position curve, a velocity curve, an acceleration curve and/or a jerk curve.

The controller section 70 is expediently adapted to compare the trajectory signal, in particular the position curve, velocity curve, acceleration curve and/or jerk curve with a state signal ZS1 obtained on the basis of the measurement variable signal and to provide the command variable signal SGS on the basis of the comparison.

The controller section 70 includes, as an example, a state determination unit 77, which provides one or more state signals ZS1, ZS2 on the basis of the measurement variable signal SGS. As an example, a first state signal ZS1 is fed to the controller unit 72 and a second state signal ZS2 is fed to a conversion and/or control unit 82. The state signals ZS1 and ZS2 can contain the same or different state variables.

The controller section 70 includes a feedforward control unit 71 and a controller unit 72, both of which the trajectory signal TS is fed to. The controller unit 72 may also be referred to as closed-loop controller unit. The feedforward control unit 71 provides a feedforward control signal VS based on the trajectory signal TS. The feedforward control unit 71 carries out a pure control—i.e. an open loop control—in which no feedback variable, in particular no measurement variable signal MGS and/or no state signal is taken into account.

The controller unit 72 provides a controller unit signal RES on the basis of the trajectory signal TS and a feedback variable. In particular, the controller unit 72 carries out a closed-loop control in which a feedback variable, in particular the measurement variable signal MGS and/or the state signal ZS1, is taken into account. As an example, the controller unit 72 compares the trajectory signal TS with the first state signal ZS1 and provides the controller unit signal RES based on the comparison.

The feedforward signal VS and the controller unit signal RES are summed to a summation signal SS by a summation element 83. The command variable signal SGS is provided on the basis of the summation signal SS. The summation signal SS specifies a mass flow for a pressure output 23, 24. The summation signal SS can also be referred to as mass flow signal and/or control signal.

The controller section 70 further includes, as an example, a conversion and/or control unit 82. The controller section 70 further includes, as an example, a frequency filter 79. The conversion and/or control unit 82 and/or the frequency filter 79 are connected between the controller unit 72 and the output of the controller section 70. As an example, the conversion and/or control unit 82 and/or the frequency filter 79 are connected between the summation element 83 and the output of the controller section 70. The command variable signal SGS output by the controller section 70 has expediently passed through the conversion and/or control unit 82 and/or the frequency filter 79.

The conversion and/or control unit 82 is adapted to convert the signal supplied to it—for example the summation signal SS—from a mass flow specification into a conductance specification and to output it as conversion signal URS. The conversion signal URS can then serve as the command variable signal SGS, for example, or—as shown in FIG. 3—first be subjected to the frequency filter 79.

As an example, the conversion and/or control unit 82 is adapted to carry out a control, in particular a closed-loop control, in which the conversion and/or control unit 82 compares, for example, the signal fed to it—here the summation signal SS—with the second state signal ZS2 and outputs the conversion signal URS as the result.

The frequency filter 79 is exemplarily designed as a bandstop filter. As an example, the conversion signal URS is fed to the frequency filter 79, on the basis of which conversion signal URS the frequency filter 79 provides a filtered signal—here the command variable signal SGS.

The controller section 70 optionally further comprises the controller parameter calculation unit 78. The controller parameter calculation unit 78 is adapted to provide, on the basis of a system parameter SP of the system model, one or more controller parameters, in particular one or more controller gains, to the controller unit 72 and/or the conversion and/or control unit 82.

In the following, exemplary embodiments of the individual components of the position controller 50 will be discussed and, in particular, various examples will be used to explain how the system model is used for the position control.

The system model includes in particular a hose model with one hose parameter. The hose parameter is a system parameter. The hose parameter is exemplarily a physical property, especially a dimension, of the hose arrangement 28, especially of the hose 51 or 52. The hose parameter especially comprises a hose length, a hose diameter and/or a hose volume. Expediently, the hose parameter is entered by a user and in particular is not determined by means of a learning run.

The system 100 expediently includes a user interface—for example the user device 49—through which the system parameter, in particular the hose parameter, can be entered by a user into the pressurized fluid provision device 4. The system parameter, especially the hose parameter, is taken into account by the position controller 50 when carrying out the position control.

As mentioned above, the pressurized fluid provision device 4 comprises the pressure sensor arrangement 29 (exemplarily the pressure sensors 43, 44, 45, 46). The pressure sensor arrangement 29 is adapted to measure a pressure of the pressurized fluid at the pressurized fluid provision device 4, especially at the valve arrangement 14. The measured pressure shall also be referred to as measurement pressure. For example, the measurement variable signal MGS comprises the measurement pressure.

The pressurized fluid provision device 4 is further adapted to calculate, using the hose model, in particular the hose parameter, a pressure of the pressurized fluid at the fluidic actuator 2 on the basis of the measurement pressure. This calculated pressure shall also be referred to as calculation pressure, actuator pressure or chamber pressure.

The measurement pressure corresponds in particular to the pressure of the pressurized fluid at one end of the hose 51, 52, which end is attached to a pressure output 23, 24 of the valve arrangement 14. The calculation pressure corresponds in particular to the pressure of the pressurized fluid at the other end of hose 51, 52, which other end is attached to the fluidic actuator 2. The hose model expediently represents a pressure drop and/or a time delay, such as a dead time that may occur between the two ends of the hose 51, 52. Based on the hose model, the calculation pressure is calculated so that the calculation pressure has the pressure drop and/or the time delay compared to the measuring pressure. Expediently, the hose model, especially the pressure drop and/or the time delay, is determined based on the hose parameter, especially by the position controller 50.

Expediently, the state determination unit 77 is adapted to carry out the calculation of the calculation pressure.

The pressurized fluid provision device 4 is expediently adapted to perform the position control using the calculation pressure. As an example, the pressurized fluid provision device 4 uses the calculation pressure as a feedback variable for the position control. In particular, the command variable signal SGS is generated under consideration of the calculation pressure. As an example, the first state signal ZS1 and/or the second state signal ZS2 comprises the calculation pressure. Preferably, the controller unit 72 and/or the conversion and/or control unit 82 carry out their control taking into account the calculation pressure, in particular as a feedback variable.

Preferably, the pressurized fluid provision device 4 is adapted to use a model-based filter, in particular the hose model, to calculate the chamber pressure from the measured pressure, for example a valve pressure, in order to perform the position control with the reconstructed chamber pressure. In this way it is in particular possible to use longer hoses for the hose 51 and/or 52 without having to provide a pressure sensor at the fluidic actuator 2. In particular, a high control quality can be achieved even with longer hoses by means of a control based on the calculation pressure. The use of a pressure sensor at the fluidic actuator 2 is not necessary, so that the associated installation and start-up costs can be avoided.

According to a preferred embodiment, the pressurized fluid provision device 4 is adapted to provide, within the position control, an acceleration signal representing the acceleration of the actuator member 3. Expediently, the acceleration signal is provided by the state determination unit 77. The position controller 50 is in particular adapted to take the acceleration signal into account as a feedback variable during the position control. As an example, the acceleration signal is contained in the first state signal ZS1 and is fed to the controller unit 72.

The pressurized fluid provision device 4, preferably the state determination unit 77, is in particular adapted to provide the acceleration signal on the basis of a twice differentiated position signal and on the basis of a pressure signal.

The position signal represents the position of the actuator member 3 and is based on the position of the actuator member 3 detected by the position sensor device 10. Expediently, the position signal is contained in the measurement variable signal MGS.

The pressure signal expediently represents a pressure of the pressurized fluid provided by the pressurized fluid provision device 4. The pressure signal is in particular the calculation pressure, which represents the pressure of the pressurized fluid at the fluidic actuator 2.

Preferably, the pressurized fluid provision device 4, in particular the state determination unit 77, is adapted to weight, when providing the acceleration signal, the twice differentiated position signal and the pressure signal as a function of frequency, so that in a first frequency range the twice differentiated position signal is dominant and in a second frequency range the pressure signal is dominant, the second frequency range being higher than the first frequency range.

As an example, the pressurized fluid provision device 4, in particular the state determination unit 77, is adapted to subject the twice differentiated position signal to low-pass filtering and to subject the pressure signal to high-pass filtering and to provide the acceleration signal on the basis of the low-pass filtered twice differentiated position signal and on the basis of the high-pass filtered pressure signal. In particular, the acceleration signal is provided as the sum of the low-pass filtered twice differentiated position signal and the high-pass filtered pressure signal. Expediently, for the acceleration signal, the portion originating from the twice differentiated position signal predominates at lower frequencies and the portion originating from the pressure signal predominates at higher frequencies.

The position sensor units 11, 12 of the position sensor device 10 may have a low signal quality under certain circumstances. Due to the low signal quality, the position signal originating from the position sensor device 10 may be noisy, which leads to a high noise level, especially at higher frequencies, when the position signal is differentiated twice. This noise can be reduced by low-pass filtering.

From the pressure signal—exemplarily the calculation pressure, in particular the calculated chamber pressures of the fluidic actuator 2—the acceleration of the actuator member 3 can also be calculated. Here, however, stationary offsets due to e.g. low-frequency external forces, especially interfering forces, and/or parameter uncertainties may be present. These offsets can be reduced by high-pass filtering.

Consequently, a sensor fusion takes place in which the low-noise high frequency range of the pressure signal and the essentially offset-free low frequency range of the acceleration signal are combined or fused for the acceleration signal. The noisy high frequency range of the twice differentiated position signal and the offset-afflicted low frequency range of the pressure signal are suppressed.

Consequently, the position control can also be used with position sensor units of low signal quality which are not actually designed for servo-pneumatics.

According to another preferred embodiment, the pressurized fluid provision device 4, in particular the position controller 50, is adapted to configure the frequency filter 79 on the basis of the system model, in particular the hose model, so that a pressurized fluid oscillation in the hose 51, 52 is suppressed. Expediently, the pressurized fluid provision device 4, in particular the position controller 50, is adapted to calculate an oscillation frequency, in particular a natural frequency (i.e. an eigenfrequency), of the pressurized fluid in the hose 51, 52 on the basis of the hose model, in particular the hose parameter, for example a hose length and/or a hose volume, and to configure the frequency filter 79 so that the calculated frequency is suppressed. The frequency to be suppressed can also be called the hose natural frequency. The frequency filter 79 is for example a bandstop filter that is set up to suppress the calculated frequency. The frequency filter 79, in particular the bandstop filter, is preferably a variable frequency filter, where the frequency to be suppressed can be continuously updated and, expediently, is continuously updated.

The pressurized fluid provision device 4, in particular the position controller 50, is preferably adapted to further configure the frequency filter 79 taking into account an actuator model, in particular an actuator parameter, for example a volume of the actuator 2. The actuator parameter is for example a pressure chamber volume of the actuator 2.

The pressurized fluid provision device 4, in particular the position controller 50, is preferably adapted to further configure the frequency filter 79 on the basis of the position of the actuator member 3. In particular, the frequency to be suppressed by the frequency filter 79 is continuously updated based on the current position of the actuator member 3. For example, the hose model and the position of the actuator member 3 are used together to calculate the oscillation frequency to be suppressed, especially the natural frequency to be suppressed.

As an example, the pressurized fluid provision device 4, in particular the position controller 50, is adapted to calculate the frequency to be suppressed on the basis of the hose model, the actuator model and the position of the actuator member 3. For example, a total volume and/or a total length (of an oscillation volume comprising the hose volume and the pressure chamber volume) is calculated on the basis of the hose model, in particular the hose volume and/or the hose length, the actuator model, in particular the pressure chamber volume and/or the pressure chamber length, and the reduction of the pressure chamber volume and/or the pressure chamber length due to the current position of the actuator member 3. Based on the total volume and/or the total length, the frequency to be suppressed can then be calculated and/or the frequency filter 79 can be configured.

When pressurized fluid is applied, the fluid, especially the compressed air, in the hose 51, 52, may be excited at the natural frequency of the hose. This can lead to acoustic hum and/or reduced controller performance. With the frequency filter 79, in particular a notch filter with variable notch frequency (exemplarily dependent on the hose and volume parameter), the command variable signal SGS can be filtered so that the excitation of the hose 51, 52 with the hose natural frequency can be prevented or reduced. The acoustic hum can thus be removed. Furthermore, a performance gain can be achieved especially for longer hoses 51, 52.

According to another preferred embodiment, the pressurized fluid provision device 4, in particular the pressure controller 50, is adapted to calculate a controller parameter for the position control, in particular a controller gain, on the basis of the system model, in particular the system parameter, and to use the controller parameter within the position control. The controller parameter is a closed-loop controller parameter, e.g. a closed-loop controller gain. Expediently, the controller parameter is calculated by the controller parameter calculation unit 78.

By means of an automatic calculation of the controller parameter, a wide range of applications can be covered. The parameterization of the position control is usually very much dependent on the physical parameters such as the mass, in particular the actuator member mass, and/or the drive cylinder dimension. The user usually does not know the relationship between the physical parameters and the controller parameter.

In the above-mentioned embodiment, the user can enter the physical parameters as a model parameter, for example via the user device 49. The position controller 50, in particular the controller parameter calculation unit 78, then carries out the calculation of the controller parameters (especially on the valve arrangement 14, in particular the valve terminal) and configures the position control according to the calculated controller parameter. Expediently, plural controller parameters are calculated.

In particular, the controller is automatically parameterized depending on the system parameter. In particular, a controller design is carried out in the controller, for example by the valve arrangement 14, in particular the valve terminal, for example the control unit 19. Expediently, the controller parameter calculation unit 78 is used to calculate the controller gains for the position control. The controller characteristics can thus be easily adjusted by a few "adjusting screws"—namely by entering one or more parameters known to the user, especially model parameters. For example, as parameters, especially model parameters, a hardness, i.e. a stiffness, of the position control and/or a resilience of the position control can be specified. Expediently, for using the position control, no user input of controller gains and/or no learning run for providing the controller gains is required.

According to a preferred embodiment, the pressurized fluid provision device 4, in particular the feedforward control unit 71, is adapted to provide the feedforward control signal VS taking into account the system model, in particular the hose model. The feedforward control unit 71 is expediently adapted to additionally take into account one or more model parameters of the system model in a classic feedforward control with exact state linearization. As an example, the feedforward control unit 71 is adapted to take into account, for providing the feedforward control signal VS, a hose volume of a hose 51, 52 and/or a dead volume of the actuator 2, in particular of the drive cylinder. As an example, the feedforward control unit 71 is adapted to add the hose volume to the dead volume as a system parameter and to take the resulting volume into account when providing the feedforward control signal VS. The feedforward control unit 71 is further adapted to take into account, as a system parameter, a pressure drop, in particular due to air friction, in hose 51, 52, when providing the feedforward control signal VS.

By taking the hose parameters into account during the feedforward control, a higher control quality can be achieved, especially with long hoses 51, 52.

The conversion and/or control unit 82 is expediently adapted to perform a mass flow control. The mass flow control is a closed-loop mass flow control. The mass flow control is expediently carried out within the position control of the actuator member 3. As an example, the conversion and/or control unit 82 compares, for the mass flow control, a setpoint mass flow, for example the summation signal SS, with an actual mass flow and, on the basis of the comparison, provides a signal—here as an example the conversion signal URS—on the basis of which the valve device 21, in particular the individual 2/2-way valves 31, 32, 33, 34 are controlled. The actual mass flow is, for example, part of the second state signal ZS2 and is expediently calculated by the state determination unit 77, in particular on the basis of output openings of the valve device 21 detected with the stroke sensors 47 and/or on the basis of detected measurement pressures of the pressure sensor arrangement 29. The conversion and/or control unit 82 is in particular adapted to use the detected output openings for a forward simulation of the valve model, in particular of a model of the valve device 21. The valve model is expediently part of the system model. As an example, the setpoint mass flow is compared with the calculated actual mass flow and fed back in a weighted manner.

Within the mass flow control, the conversion and/or control unit 82 expediently performs a control (i.e. a closed-loop control) and a feedforward control (e.g. an open-loop control). The position controller 50, in particular the conversion and/or control unit 82, is expediently adapted to record, in particular in (normal) operation, i.e. "online", the dynamic behavior, i.e. in particular the frequency response and/or the bandwidth, of the valve device 21, in particular of a 2/2-way valve 31, 32, 33, 34 and/or of the mass flow control. Expediently, the position controller determines one or more dynamic parameters that describe the dynamic behavior.

Expediently, the position controller 50, in particular the conversion and/or control unit 82, is adapted to adjust the mass flow control on the basis of the detected dynamic behavior, in particular on the basis of the dynamic parameter (s), so that the dynamic behavior, in particular the frequency response and/or the bandwidth of the mass flow control is improved or increased, expediently by increasing controller gains of the mass flow control. Expediently, the position controller 50, in particular the conversion and/or control unit 82, is adapted to carry out the recording and adjusting of the dynamic behavior several times over the service life of the valve device 21, so that a deterioration of the dynamic behavior caused by ageing is reduced.

Expediently, the position controller 50 is adapted to carry out an increase in bandwidth during the (closed-loop) control and/or feedforward control of the mass flow control, in particular on the basis of the dynamic parameters of the dynamic behavior of the valve device 21. Expediently, the position controller 50 is adapted to reduce an effect of the dynamic stroke controller deviation using a valve model. The valve model is in particular part of the system model. Furthermore, the position controller 50 is especially adapted to increase the bandwidth in the closed position control loop.

Expediently, the pressurized fluid provision device 4 is further adapted to calculate on the basis of the detected dynamic behavior, in particular on the basis of the dynamic parameter, a (remaining) lifetime for the valve arrangement 14, in particular the valve device 21.

Figure 4:
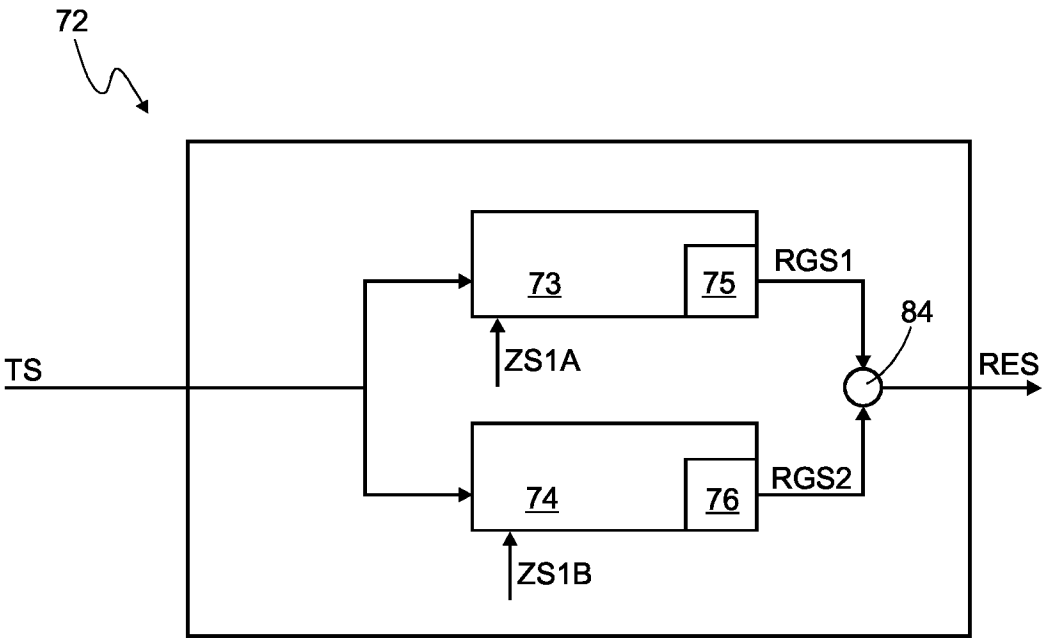

With reference to FIG. 4, an exemplary design of the controller unit 72 is described below.

The controller unit 72 comprises two controller elements, which are connected in parallel—a first controller element 73 and a second controller element 74. The first controller element 73 is a closed-loop controller element and the second controller element 74 is a closed-loop controller element.

The first controller element 73 is adapted to provide a first controller element signal RGS1 based on the trajectory signal TS and a state signal ZS1A. Expediently, the first controller element 73 provides the first controller element signal RGS1 based on an acceleration error determined by the first controller element 73. Expediently, the controller element signal RGS1 represents an acceleration error, especially of the actuator member 3. The first controller element 73 can also be referred to as an acceleration-based controller. The state signal ZS1A is expediently provided by the state determination unit 77 and is in particular part of the first state signal ZS1. The state signal ZS1A comprises in particular a position and/or velocity and/or acceleration of the actuator member 3 provided by means of the position sensor device 10. The state signal ZS1A expediently further comprises a mean pressure or average pressure, i.e. a pressure level, of the fluidic actuator 2 calculated on the basis of plural (in particular calculated) chamber pressures. The first controller element 73 expediently comprises a low-pass filter 75, which the first controller element signal RGS1 passes through.

The second controller element 74 is adapted to provide a second controller element signal RGS2 on the basis of the trajectory signal TS and a state signal ZS1B. Expediently, the second controller element 74 provides the second controller element signal RGS2 on the basis of a pressure error determined by the second controller element 74. Expediently, the second controller element signal RGS2 represents a pressure error, especially of a pressure chamber 8, 9 of the actuator 2. The second controller element 73 can also be referred to as pressure-based controller. The state signal ZS1B is expediently provided by the state determination unit 77 and is in particular part of the first state signal ZS1. The state signal ZS1B is expediently different from the state signal ZS1A. The state signal ZS1B comprises in particular a position and/or velocity of the actuator member 3 provided by means of the position sensor device 10. The state signal ZS1B expediently further comprises one or more (in particular calculated) chamber pressures of the fluidic actuator 2. The second controller element 74 expediently comprises a high-pass filter 76 through which the second controller element signal RGS2 passes.

The low-pass filter 75 and the high-pass filter 76 together can also be called a crossover or frequency-separating filter.

Based on the first controller element signal RGS1 and the second controller element signal RGS2, the controller unit signal RES is provided. Expediently, the first controller element signal RGS1 and the second controller element signal RGS2 are summed to the controller unit signal RES by a summation element 84. Alternatively, the controller element signals RGS1 and RGS2 can also be fed directly to the summation element 83, where they are added to the feedforward control signal VS.

The pressurized fluid provision device 4 is expediently adapted to provide the command variable signal SGS for position control on the basis of the first controller signal RGS1 and the second controller signal RGS2. The pressurized fluid provision device 4, in particular the controller unit 72, is adapted to provide the first controller signal RGS1 in accordance with an acceleration of the actuator member 3 and the second controller signal RGS2 in accordance with a pressure, in particular a calculation pressure, of the actuator 2. The pressurized fluid provision device 4 is adapted to weight the first controller signal RGS1 and the second controller signal RGS2 as a function of frequency when providing the command variable signal SGS, so that the first controller signal RGS1 predominates in a first frequency range and the second controller signal RGS2 predominates in a second frequency range, the second frequency range being higher than the first frequency range.

Expediently, in the first frequency range, the attenuation caused by the low-pass filter 75 is less than the attenuation caused by the high-pass filter 76, and in the second frequency range, the attenuation caused by the low-pass filter 75 is greater than the attenuation caused by the high-pass filter 76. In particular, a frequency-dependent weighting takes place, so that the first controller element signal RGS1 (as a component of the controller unit signal RES) is weighted more strongly than the second controller element signal RGS2 in the first frequency range and the second controller element signal RGS2 (as a component of the controller unit signal RES) is weighted more strongly than the first controller element signal RGS1 in the second frequency range.

The controller unit 72 is in particular adapted to provide, in a classical feedback of the exact state linearization, a feedback of the acceleration error and pressure error weighted via the crossover.

In this way, the advantages of each (closed-loop) control can be combined and the disadvantages suppressed. The exemplary acceleration feedback performed by the first controller element 73 can achieve the advantage of stationary accuracy and interference stiffness in particular. However, the acceleration signal (for example, because it is obtained by differentiating the position signal) can be very noisy. In addition, re-pumping of the chamber pressures can occur due to a stick-slip effect. Due to the pressure feedback provided by the second controller element 74, a higher performance can be achieved for dynamic processes. In particular, re-pumping can be prevented.

What is claimed is:

1. A system comprising:

a pneumatic actuator, which can be acted upon by pressurized air, the pneumatic actuator having an actuator member;

a pressurized fluid provision device which is adapted to carry out a position control of the actuator member and, within the position control, to apply the pressurized air to the pneumatic actuator in order to move the actuator member into a prescribed position; and a hose arrangement comprising at least one hose via which the pneumatic actuator is fluidically connected to the pressurized fluid provision device, wherein the pressurized fluid provision device is adapted to perform the position control taking into account a system model describing the hose arrangement, and wherein the system model comprises a hose model with a hose parameter, wherein the hose parameter comprises a hose length, a hose diameter and/or a hose volume of the at least one hose of the hose arrangement.

2. The system according to claim 1, wherein the system model comprises a system parameter and the system has a user interface via which the system parameter can be entered by a user into the pressurized fluid provision device.

3. The system according to claim 1, wherein the pressurized fluid provision device comprises a frequency filter and is adapted to provide, within the position control, a command variable signal using the frequency filter, and wherein the pressurized fluid provision device is further adapted to configure the frequency filter on the basis of the system model so that a pressurized air oscillation in the hose is suppressed.

4. The system according to claim 3, wherein the pressurized fluid provision device is adapted to detect the position of the actuator member and to configure the frequency filter on the basis of the detected position of the actuator member.

5. The system according to claim 1, wherein the pressurized fluid provision device is adapted to calculate, on the basis of the system model, a controller parameter for the position control and to use the controller parameter for the position control.

6. The system according to claim 1, wherein the pressurized fluid provision device is adapted to provide a command variable signal for the position control on the basis of a first controller signal and a second controller signal, wherein the pressurized fluid provision device is adapted to provide the first controller signal in accordance with an acceleration of the actuator and the second controller signal in accordance with a pressure of the actuator.

7. The system according to claim 1, wherein the pressurized fluid provision device is adapted to provide a command variable signal for the position control on the basis of a feedforward control signal, wherein the pressurized fluid provision device is adapted to provide the feedforward control signal taking into account a hose model and/or a pressure drop in the hose.

8. The system according to claim 1, wherein the pressurized fluid provision device is adapted to provide, within the position control, an acceleration signal representing the acceleration of the actuator member, wherein the pressurized fluid provision device is adapted to provide the acceleration signal on the basis of a twice differentiated position signal representing the position of the actuator member and on the basis of a pressure signal.

9. The system according to claim 1, wherein the pressurized fluid provision device is adapted to detect a dynamic parameter describing the dynamic behavior of the position control, and to adapt a controller parameter on the basis of the dynamic parameter.

10. The system according to claim 1, wherein the pressurized fluid provision device has a valve arrangement designed as a series module arrangement, which valve arrangement comprises one or more plate-shaped valve modules for supplying the pressurized fluid, the plate-shaped valve modules being arranged in a row.

11. A system comprising:

a pneumatic actuator, which can be acted upon by pressurized air, the pneumatic actuator having an actuator member;

a pressurized fluid provision device which is adapted to carry out a position control of the actuator member and, within the position control, to apply the pressurized air to the pneumatic actuator in order to move the actuator member into a prescribed position; and a hose arrangement comprising at least one hose via which the pneumatic actuator is fluidically connected to the pressurized fluid provision device, wherein the pressurized fluid provision device is adapted to perform the position control taking into account a system model comprising a hose model describing the hose arrangement, and wherein the pressurized fluid provision device has a pressure sensor arrangement which is adapted to measure a pressure of the pressurized air at the pressurized fluid provision device and to provide the measured pressure as a measurement pressure, and wherein the pressurized fluid provision device is adapted to calculate a pressure of the pressurized air at the pneumatic actuator using the hose model and the measurement pressure and to provide the calculated pressure as a calculation pressure.

12. The system according to claim 11, wherein the hose model comprises a hose parameter, wherein the hose parameter comprises a hose length, a hose diameter and/or a hose volume of the at least one hose of the hose arrangement.

13. The system according to claim 11, wherein the pressurized fluid provision device is adapted to perform the position control using the calculation pressure.

14. A system comprising:

a fluidic actuator, which can be acted upon by a pressurized fluid, the fluidic actuator having an actuator member;

a pressurized fluid provision device which is adapted to carry out a position control of the actuator member and, within the position control, to apply the pressurized fluid to the fluidic actuator in order to move the actuator member into a prescribed position; and a hose arrangement comprising at least one hose via which the fluidic actuator is fluidically connected to the pressurized fluid provision device, wherein the pressurized fluid provision device is adapted to perform the position control taking into account a system model describing the hose arrangement, the actuator and/or the pressurized fluid provision device, and wherein the pressurized fluid provision device is adapted to provide a command variable signal for the position control on the basis of a first controller signal and a second controller signal, wherein the pressurized fluid provision device is adapted to provide the first controller signal in accordance with an acceleration of the actuator and the second controller signal in accordance with a pressure of the actuator, and wherein the pressurized fluid provision device is adapted to weight, for the provision of the command variable signal, the first controller signal and the second controller signal as a function of frequency, so that the first controller signal is dominant in a first frequency range and the second controller signal is dominant in a second frequency range, the second frequency range being higher than the first frequency range.

15. A system comprising:

a fluidic actuator, which can be acted upon by a pressurized fluid, the fluidic actuator having an actuator member;

a pressurized fluid provision device which is adapted to carry out a position control of the actuator member and, within the position control, to apply the pressurized fluid to the fluidic actuator in order to move the actuator member into a prescribed position; and a hose arrangement comprising at least one hose via which the fluidic actuator is fluidically connected to the pressurized fluid provision device, wherein the pressurized fluid provision device is adapted to perform the position control taking into account a system model describing the hose arrangement, the actuator and/or the pressurized fluid provision device, and wherein the pressurized fluid provision device is adapted to provide, within the position control, an acceleration signal representing the acceleration of the actuator member, wherein the pressurized fluid provision device is adapted to provide the acceleration signal on the basis of a twice differentiated position signal representing the position of the actuator member and on the basis of a pressure signal, and wherein the pressurized fluid provision device is adapted to weight, for the provision of the acceleration signal, the twice differentiated position signal and the pressure signal as a function of frequency, so that the twice differentiated position signal is dominant in a first frequency range and the pressure signal is dominant in a second frequency range, the second frequency range being higher than the first frequency range.

16. A method of operating a system comprising: a pneumatic actuator, which can be acted upon by pressurized air, the pneumatic actuator having an actuator member, a pressurized fluid provision device which is adapted to carry out a position control of the actuator member and, within the position control, to apply the pressurized air to the pneumatic actuator in order to move the actuator member into a prescribed position, and a hose arrangement comprising at least one hose via which the pneumatic actuator is fluidically connected to the pressurized fluid provision device, wherein the pressurized fluid provision device is adapted to perform the position control taking into account a system model describing the hose arrangement, the method comprising the step of: performing position control taking into account the system model, wherein the system model comprises a hose model with a hose parameter, wherein the hose parameter comprises a hose length, a hose diameter and/or a hose volume of the at least one hose of the hose arrangement.

* * * * *